US008745803B2

(12) United States Patent
Fulton et al.

(10) Patent No.: US 8,745,803 B2
(45) Date of Patent: Jun. 10, 2014

(54) MODEL TRAIN CAR AND ENGINE WHEEL CLEANING DEVICE AND METHOD

(75) Inventors: C. Dwayne Fulton, Osage Beach, MO (US); Dennis M. Rupp, Sunrise Beach, MO (US)

(73) Assignee: David L. Osment, Naples, FL (US)

( * ) Notice: Subject to any disclaimer, the term of this patent is extended or adjusted under 35 U.S.C. 154(b) by 0 days.

(21) Appl. No.: 13/249,479

(22) Filed: Sep. 30, 2011

(65) Prior Publication Data

US 2013/0081651 A1 Apr. 4, 2013

(51) Int. Cl.
*A47L 11/04* (2006.01)

(52) U.S. Cl.
USPC ..... 15/97.1

(58) Field of Classification Search
CPC ..... A47L 11/4069; A47L 11/4038; A47L 11/4075; G11B 23/505; A63B 47/04; A63H 18/02; A63H 18/12
USPC ..... 15/97.1, 224, 244.4, 53.4; 134/32, 39, 134/40
IPC ..... A63H 18/02, 18/12
See application file for complete search history.

(56) References Cited

U.S. PATENT DOCUMENTS

| | | | | |
|---|---|---|---|---|
| 5,651,835 | A * | 7/1997 | Skidmore | 134/32 |
| 5,816,168 | A | 10/1998 | Poissant | |
| 5,904,100 | A | 5/1999 | Findley et al. | |
| 6,536,355 | B1 | 3/2003 | Amemiya | |
| 6,758,145 | B1 | 7/2004 | Hefter | |
| 6,904,847 | B2 * | 6/2005 | Bielka | 104/307 |
| 7,597,049 | B2 | 10/2009 | Leonowicz | |

FOREIGN PATENT DOCUMENTS

| | | | |
|---|---|---|---|
| DE | 1 150 607 | B | 6/1963 |
| DE | 19 58 453 | U | 4/1967 |
| DE | 30 09 372 | A1 | 9/1981 |
| DE | 197 57 483 | A1 | 6/1999 |
| JP | 2000-262770 | * | 9/2000 |

OTHER PUBLICATIONS

Robert Bielka, A locomotive wheel cleaner, Model Railroader, Jun. 2003, p. 41, unknown.
Product Information; Trackman 2000; http://www.elmassian.com/20-train/track?start=10, published at least as early as Aug. 21, 2009.

(Continued)

*Primary Examiner* — Robert Scruggs
(74) *Attorney, Agent, or Firm* — Stinson Leonard Street LLP

(57) ABSTRACT

A model train car or engine wheel cleaning device includes a cradle having a base plate and side walls. Cleaning strips are mounted on the side walls and a spring loaded core is located there between. The core is moveable between a neutral position and a compressed position. Conductive strips are positioned on top of the core. Electrical contacts are electrically connected to the conductive strips. During use, the core is in the compressed position and the rail contact surfaces of the wheels contact the cleaning strips. When cleaning a model train engine with motorized wheels, the wheel rims are in contact with the conductive strips and an electric current is supplied to the electrical contacts, causing the wheels to turn and be cleaned. When cleaning a model train car with free-spinning wheels, the car is manually moved back and forth, causing the wheels to turn and be cleaned.

17 Claims, 4 Drawing Sheets

(56) References Cited

OTHER PUBLICATIONS

Product Information, Track Scrubbing Car; http://www.elmassian.com/20-train/track?start=10,; published at least as early as Dec. 11, 2008.
Product Information; Tomix Product; http://www.trainweb.org/tomix/intro/intro.htm#cleaner; published at least as early as Jun. 4, 2010.
Product Information; The HO Dual Motorized Track Cleaning Car; http://www.mnpinc.com/ho_scale.htm; published at least as early as Sep. 5, 2008.
Product Information; HO Scale Maintenance of the Way 1-Roller Track Cleaning Car; http://www.aztectrains.com/HO_4.html; published at least as early as Dec. 8, 2008.
Product Information; CMX N Scale "The Clean Machine" Ultimate Track Cleaning Car w/Micro-Trains Couplers; http://www.internettrains.com/merchant2/merchant.mvc?Screen=PROD&Store_Code=IT&Product_Code=CMX-TTE-CMXN&Category_Code=NSCRLSCLNCMX&Featured=; published at least as early as May 28, 2010.
Product Information; Bright Boy Abrasive Track Cleaner; http://www.walthers.com/exec/productinfo/949-521; published at least as early as Jun. 22, 2009.
Product Information; HO Gauge Track Cleaner; http://www.micromark.com/Cleaning.html; published at least as early as Mar. 18, 2009.
Product Information; 18" Gumbuster EZN; http://www.cleantrains.com/id20.htm; published at least as early as May 31, 2006.
Product Information; 'Speedi' Driver Cleaner; http://www.kadee.com/htm1/236-843ins.pdf; published at least as early as Sep. 16, 2008.
Product Information; Trix N/Z 66623 Electric Locomotive Wheel Cleaning Brush; http://www.modeltrainstuff.com/Trix-N-Z-Wheel-Cleaner-p/trx-66623.htm; published at least as early as Apr. 15, 2008.
Product Information; Atlas Code 83 Easy to Use Non-Abrasive Locomotive Wheel Cleaner; http://www.rodneysrrtools.com/ho83wcinfo.html; published at least as early as Jun. 9, 2009.
Product Information; Rail Cleaner~Die-Cast~Kadee #500 trucks and Kadee #5 knuckle couplers; http://www.centerline-products.com/rail_wheel.htm; published at least as early as May 19, 2008.
Product Information; Locomotive Wheel Cleaning Station; http://www.micromark.com/locomotive-wheel-cleaning-station,7796.html; published at least as early as Nov. 10, 2009.
Product Information Atlas HO Track Cleaning Car; http://www.atlasrr.com/hofreight/hotrackcleaningcar.htm; published at least as early as Oct. 6, 2009.
Product Information; Aztex Model Railroad Accessories; http://www.aztectrains.com/; published at least as early as Dec. 8, 2008.
Product Information; Peco PL-41 Abrasive Rubber Block Rail/Track Cleaner; http://www.modeltrainstuff.com/Peco-PL-41Abrasive-Rubber-Block-Rail-Track-Cl-p/pec-pl41.htm; published at least as early as Dec. 16, 2009.
Product Information; Bright Bar, 240 Grit; http://www.micromark.com/Briqht-Bar-240-Grit,7483.html; published at least as early as Nov. 12, 2009.
Product Information; HO Gauge Track Cleaner; http://www.micromark.com/ho-gauge-track-cleaner,8301.html; published at least as early as Mar. 18, 2009.
Product Information; Standard Speedi Driver Cleaner; http://www.micromark.com/Standard-Speedi-Driver-Cleaner,8630.html; published at least as early as Nov. 10, 2009.
European Patent Office Search Report dated Jan. 22, 2013 from related European Patent Application No. 12183489.9 filed Sep. 7, 2012.

* cited by examiner

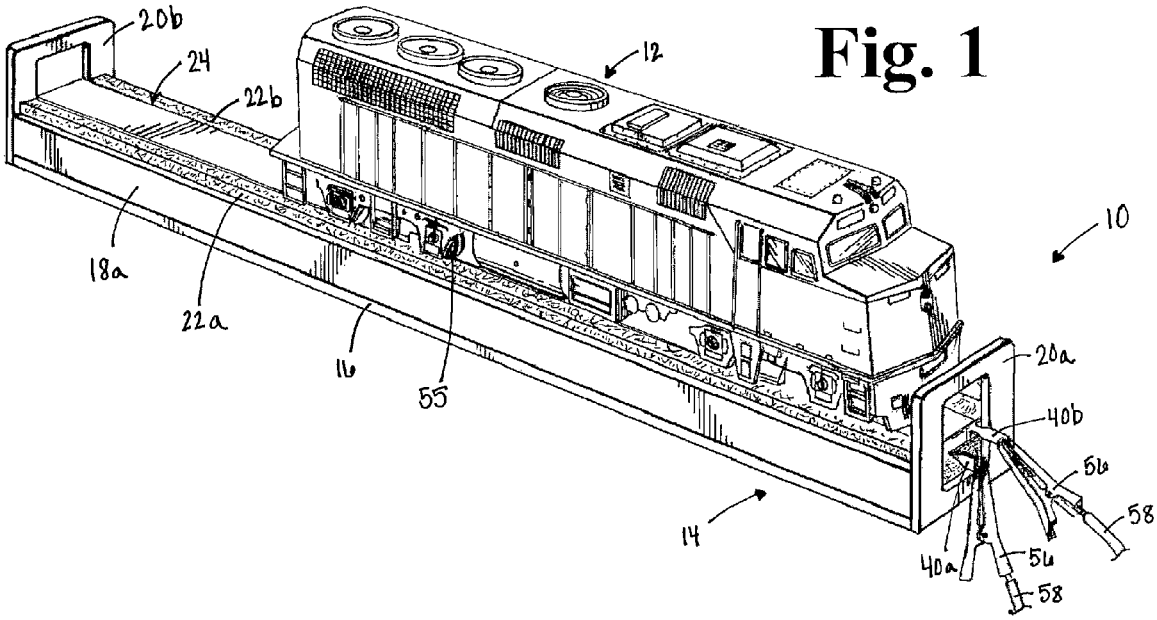
Fig. 1
Fig. 2
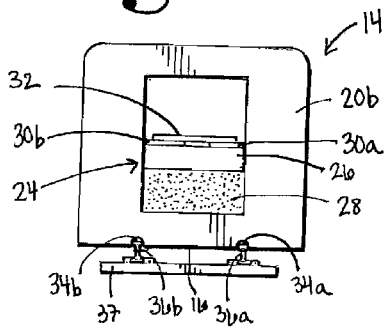

MODEL TRAIN CAR AND ENGINE WHEEL CLEANING DEVICE AND METHOD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Train modeling is a unique hobby that provides a creative outlet for children and adults alike. Various model track pieces and accessories are assembled into a model layout on which model trains run. The layout can be modeled in various scales or gauges. HO is one of the most popular scales among train modelers. In HO scale, every 1 inch represents 87 inches and the rails on HO scale train track are only approximately 0.65 inches apart. Needless to say, the train wheels and other components on an HO scale layout are relatively small and can be difficult to clean. Smaller scales, such as N scale, are also popular.

Model trains are often powered by electricity. The train engine typically has at least two pairs of metal wheels and houses an electric motor that causes the wheels to turn. The motor in the train engine is powered by an electric current flowing through the rails of the train track. The wheels each have a rim and a rail contact surface. The rim guides the wheel along the track rail while the rail contact surface is in electrical contact with the track rail. Because the wheels are metal, they have a tendency to oxidize and often become coated with adhesives, oil, grease and other materials used on the model layout. It is important that the track rails and the rail contact surfaces of the wheels are clean as dirt buildup will interfere with the electrical connection and negatively affect performance.

Any number of train cars can be hitched to the engine and pulled around the track. Each train car has at least two pairs of non-motorized, free-spinning wheels. Model train car wheels can be made of metal and used to conduct electric current from the track into the car to power accessories such as lights. Some model train car wheels are plastic and create static electricity as they travel around the track, which attracts dust and other contaminants to the wheels and track. Regardless of what the wheels are made, the rail contact surfaces should be kept clean to prevent soiling or damaging the rails, causing uneven wear and tear to the wheels or rails, or negatively impacting conductivity between the car accessory and the track. Excessive dirt buildup can also cause derailment.

Most model trains operate on a two-rail track system. In a two-rail system, the track has two metal rails through which an electric current generated by a power supply flows. When a train engine is placed on the track, the current flows up from a first rail, through the metal wheels of the train and to the electric motor. The current is returned through the wheels on the other side of the engine and into a second rail, where it flows back to the power supply thereby completing the circuit. The electric motor inside the train engine, powered by the electric current, causes the train engine wheels to turn.

Some model trains operate on a three-rail track system. In a three-rail system, the track has three metal rails through which an electric current generated by a power supply flows. A train engine designed to run on a three-rail track has a metal skid between the wheels that is in electrical contact with the middle rail when the train engine is placed on the track. Electric current flows up from the middle rail, through the metal skid of the engine and to the electric motor. The current is returned through the wheels to the outer rails where it flows back to the power supply thereby completing the circuit. The electric motor inside the train engine, powered by the electric current, causes the train engine wheels to turn.

BRIEF SUMMARY OF THE INVENTION

The present invention is directed to a model train engine and car wheel cleaning device and method. The device includes a cradle having a base plate and a first and second side wall on opposite sides of the base plate. The bottom surface of the base plate defines a first and second rail groove, each of which is of a size and shape to receive a track rail when the cradle is placed on the track. A first cleaning strip is mounted to the top of one side wall and a second cleaning strip is mounted to the top of the other side wall. A spring loaded core is located between the side walls and is moveable relative to the cleaning strips between a neutral position and a compressed position. On top of the core, first and second conductive strips are at least partially exposed adjacent to and along the length of an elongated wheel guide. Electrical contacts are electrically connected with the conductive strips. In the preferred embodiment, there are two types of electrical contacts—the first type extends into the rail grooves in the base plate as track contacts and the second type extends from the end of the cradle as prongs. During use with a model train engine with motorized wheels that do not spin freely, the electrical contacts are used to supply electric current to the motor inside the engine, which causes the wheels to turn.

To clean train engine wheels using the first type of electrical contacts on the wheel cleaning apparatus, the cradle is placed on a piece of train track connected to a power supply. The rail grooves receive the track rails such that the rails are electrically connected to the track contacts. When a train engine is placed on the cradle such that the wheels are positioned on either side of the wheel guide and the core is compressed, the rail contact surfaces of the wheels contact the cleaning strips. In this position, the wheel rims contact the conductive strips and electric current flows from the track rails, through the track contacts, conductive strips and wheels, and to the electric motor in the engine, which causes the wheels to turn and the rail contact surfaces to be cleaned by the cleaning strips.

To clean train engine wheels using the second type of electrical contacts on the wheel cleaning apparatus, a power supply is electrically connected to the prongs. When a train engine is placed on the cradle such that the wheels are positioned on either side of the wheel guide and the core is compressed, the rail contact surfaces of the wheels contact the cleaning strips. The wheel rims contact the conductive strips and electric current flows from the power supply, through the prongs, conductive strips, and wheels, and to the electric motor in the engine, which causes the wheels to turn and the rail contact surfaces to be cleaned by the cleaning strips.

To clean train car wheels that are not motorized and spin freely, the car is placed on the cradle such that the wheels are positioned on either side of the wheel guide and the core is compressed. The rail contact surfaces of the wheels contact the cleaning strips. As the train car is pushed back and forth along the length of the cradle, the train car wheels turn and are cleaned by the cleaning strips.

Cleaning model train engine and car wheels using the apparatus of the present invention enhances model train performance in that it removes dirt buildup that can interfere with the electrical connection required between the train wheels and the track for the train to run properly. Clean wheels are particularly important on digital command control layouts where digital signals are transmitted through the track to the model train engines. Although each train car or engine wheel may be individually cleaned using cloths and pads known in the art, the present invention saves time in that it cleans all the wheels at once and ensures that the wheels are thoroughly and uniformly cleaned without damaging the rail contact surfaces of the wheels. Importantly, this device allows only the wheel rims to contact the conductive strips or core during cleaning so as to protect the rail contact surfaces from damage or excessive wear. The wheel cleaning apparatus also safely cleans the wheels of model train engines, which are particularly difficult to clean manually as they do not spin freely like the non-motorized wheels on train cars.

Additional aspects of the invention, together with the advantages and novel features appurtenant thereto, will be set forth in part in the description that follows and in part will become apparent to those skilled in the art upon examination of the following or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 1 is a perspective view of a model train engine placed on the model train wheel cleaning device of the present invention.

FIG. 2 is an end view of the wheel cleaning device of the present invention.

DETAILED DESCRIPTION OF PREFERRED EMBODIMENT

Figure 5:
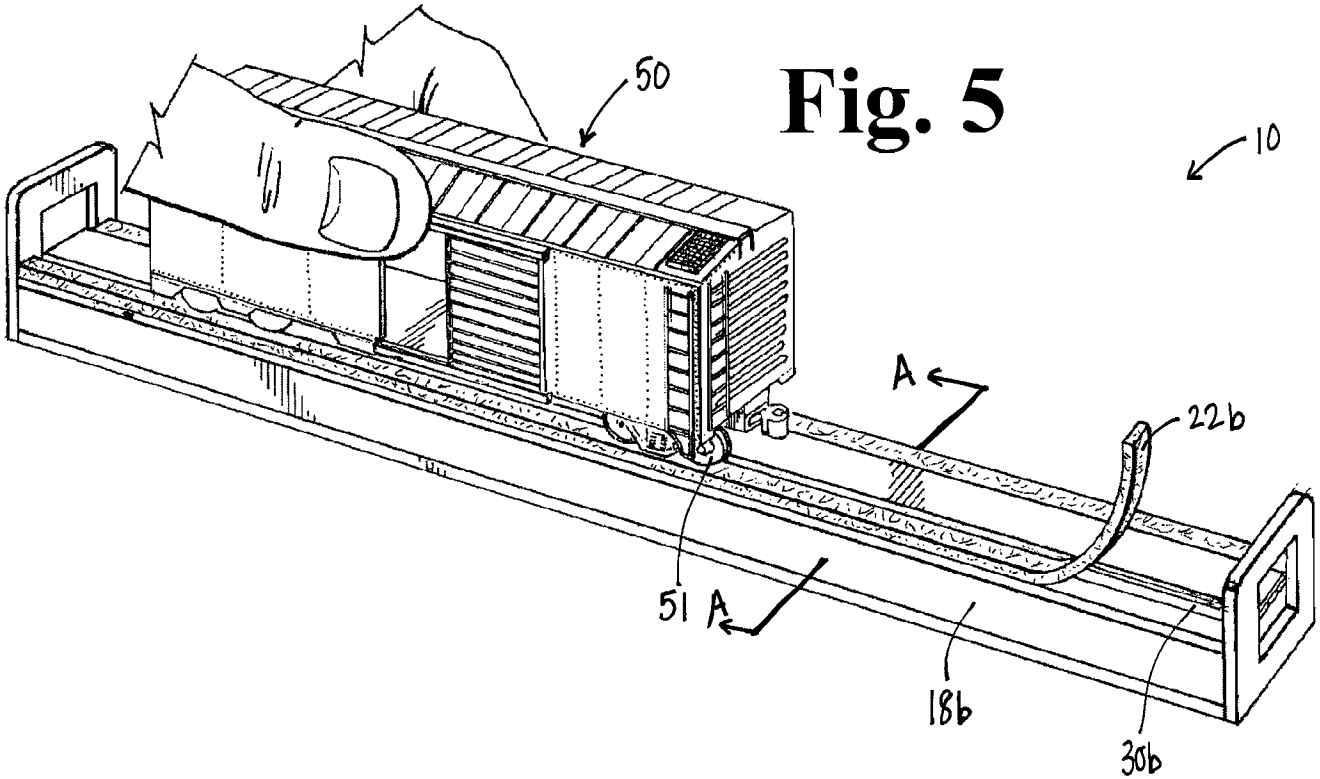
FIG. 5 is a perspective view of a model train car positioned on the model train wheel cleaning device of the present invention, where a portion of one of the cleaning strips has been partially dislodged from the side wall.

With reference to FIG. 1, the wheel cleaning device of the present invention is shown generally as reference numeral 10. A model train engine 12 is shown mounted thereon. The wheel cleaning device includes a cradle 14. Cradle 14 has an elongated shape and includes a base plate 16. Cradle 14 also includes a first side wall 18*a* and a second side wall 18*b* (as shown in FIG. 5) on opposite sides of base plate 16 and a first end wall 20*a* and a second end wall 20*b* on opposite ends of base plate 16. A first cleaning strip 22*a* is mounted on top of sidewall 18*a* and a second cleaning strip 22*b* is mounted on top of sidewall 18*b*. Preferably, cleaning strips 22*a* and 22*b* are made of a material suitable for cleaning a metal or plastic component, such as a stiff fabric or interfacing textile. Most preferably, the cleaning strips are made of an absorbent material. Cleaning strips 22*a* and 22*b* are removably mounted on side walls 18*a* and 18*b*, respectively, so that they may be replaced. A spring loaded core 24 is located between sidewalls 18*a* and 18*b*. Core 24 has an elongated shape and is moveable relative to cleaning strips 22*a* and 22*b* between a neutral position and a compressed position.

Figure 6:
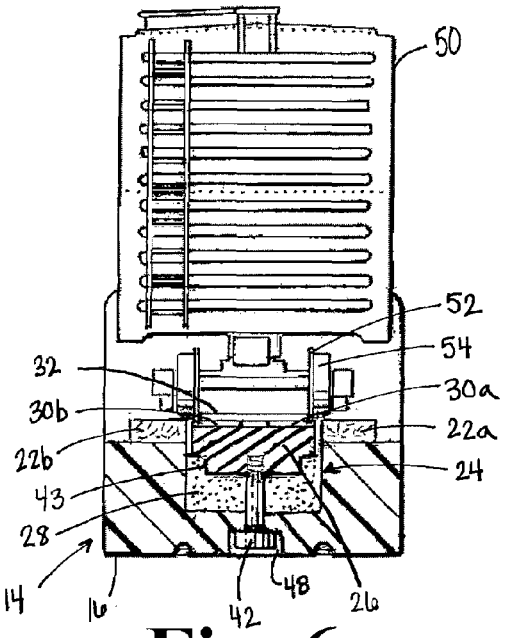
FIG. 6 is a cross-sectional view of the wheel cleaning device of the present invention, taken along line A-A of FIG. 5, with a train car positioned thereon.
Figure 7:
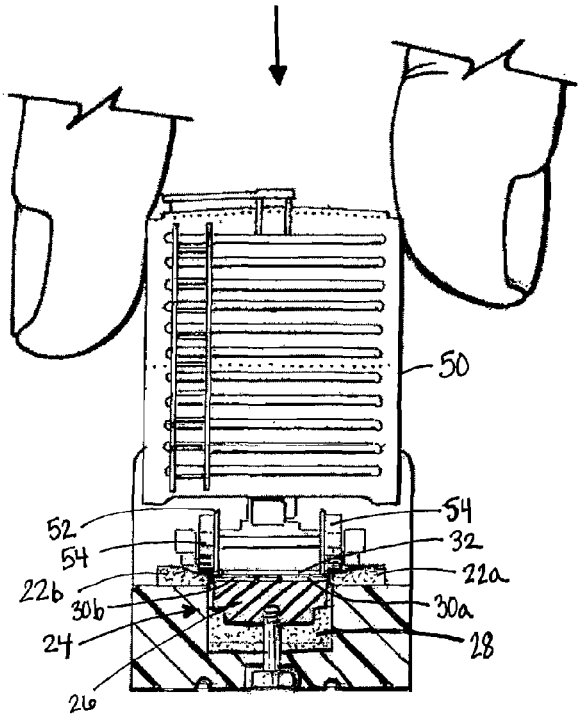
FIG. 7 is a cross-sectional view of the wheel cleaning device of the present invention, taken along line A-A of FIG. 5, while in use.

With reference to FIG. 2, spring loaded core 24 has a rigid layer 26 and a resilient portion, namely a foam layer 28. Rigid layer 26 has a top surface on which a first conductive strip 30*a* and a second conductive strip 30*b* are mounted. Conductive strips 30*a* and 30*b* are made of conductive material, such as metal, and have a length approximately equal to the length of core 24. An elongated wheel guide 32 is also mounted to the top of core 24. Wheel guide 32 also has a length approximately equal to the length of core 24 and is sized to fit between the rims of the wheels on opposite sides of a model train engine or car when the engine or car is placed on device 10. Conductive strips 30*a* and 30*b* are exposed adjacent to wheel guide 32 such that the rims of the train engine or car wheels contact one of the conductive strips during use. Foam layer 28 supports rigid layer 26. In the preferred embodiment, foam layer 28 comprises open-cell foam blocks positioned at intervals beneath rigid layer 26. When core 24 is in a neutral position (as shown in FIG. 6), foam layer 28 supports rigid layer 26 at approximately the same height as cleaning strips 22*a* and 22*b*. When moved into a compressed position in response to downward pressure (as shown in FIG. 7), foam layer 28 is compressed to support rigid layer 26 is at a height below cleaning strips 22*a* and 22*b*. When the pressure is removed, core 24 returns to the neutral position by virtue of foam layer 28 expanding and raising rigid layer 26 to the height of cleaning strips 22*a* and 22*b*.

Figure 3:
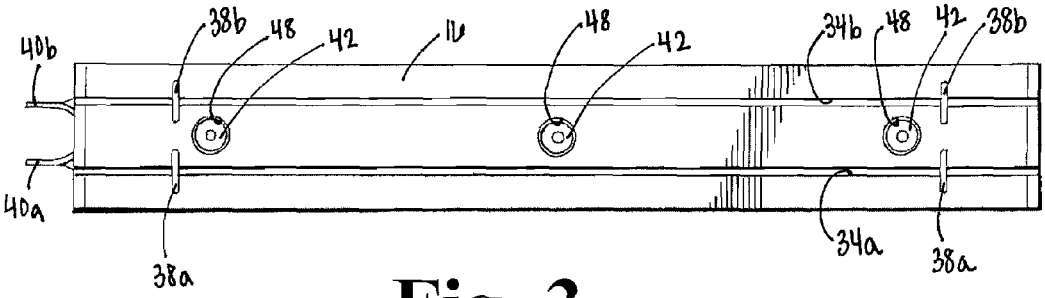
FIG. 3 is a bottom view of the model train wheel cleaning device of the present invention.
Figure 4:
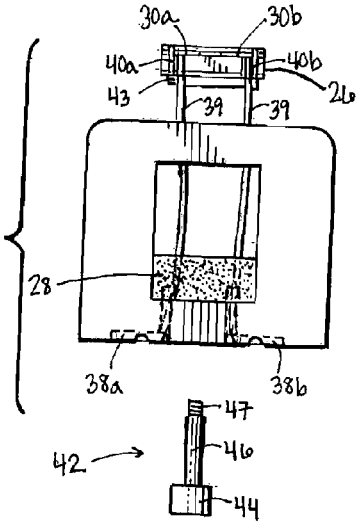
FIG. 4 is an exploded end view of the model train wheel cleaning device of the present invention.

With further reference to FIG. 2, base plate 16 defines a first rail groove 34*a* and a second rail groove 34*b*. Rail grooves 34*a* and 34*b* are of a size and shape to receive a first track rail 36*a* and a second track rail 36*b* on a model train track 37. As shown in FIG. 3, rail grooves 34*a* and 34*b* run the length of base plate 16. A first track contact 38*a* and a second track contact 38*b* are provided as a first type of electrical contacts. In the preferred embodiment, two of each of track contacts 38*a* and 38*b* are provided. Track contacts 38*a* and 38*b* are metal posts electrically connected to conductive strips 30*a* and 30*b*, respectively, as shown in FIG. 4. The electrical connection between track contacts 38*a* and 38*b* and conductive strips 30*a* and 30*b* is accomplished using at least two wires 39 and soldering techniques as known in the electrical arts. Track contacts 38*a* and 38*b* extend into rail grooves 34*a* and 34*b*, respectively, such that when cradle 14 is placed on track 37, as shown in FIG. 2, rail 36*a* is in electrical connection with conductive strip 30*a* and rail 36*b* is in electrical connection with conductive strip 30*b*.

As shown in FIG. 1, the preferred embodiment of wheel cleaning device 10 has a second type of electrical contacts, namely a first prong 40*a* and a second prong 40*b*. Prongs 40*a* and 40*b* extend from one end of cradle 14 and are electrically connected to conductive strips 30*a* and 30*b*, respectively. The electrical connection between prongs 40*a* and 40*b* and conductive strips 30*a* and 30*b* is accomplished using soldering techniques known in the art.

With reference to FIGS. 3 and 4, the preferred embodiment of wheel cleaning device 10 also includes a plurality of pegs 42 removably coupled with a plurality of mounting portions 43 of rigid layer 26 at regular intervals. Each peg has a head 44 and a stem 46. Preferably, pegs 42 are shoulder bolts having a threaded portion 47 near the end of stem 46. Each of mounting portions 43 defines a counter-threaded cavity (not shown) of a size and shape to receive threaded portion 47. Base plate 16 defines a plurality of apertures 48, each of which is shaped to retain head 44 but permit stem 46 to extend through base plate 16 where threaded portion 47 is screwed into the cavity of one of mounting portions 43. When assembled, pegs 42 hold core 24 between side walls 18*a* and 18*b* such that core 24 is not permitted to slide laterally along the length of cradle 14 or be lifted out from between side walls 18*a* and 18*b*. Mounting portions 43 also function to prevent rigid layer 26 from crushing track contacts 38*a* and 38*b* and wires 39 in the event core 24 is forced past the compressed position.

With reference to FIG. 5, wheel cleaning device 10 is shown with a model train car 50 having free-spinning wheels 51 placed thereon. A cross-section of device 10, taken along line A-A, is shown in FIGS. 6 and 7. Each of wheels 51 has a wheel rim 52 and a rail contact surface 54. When train car 50 is placed on device 10, each wheel rim 52 is positioned on either side of wheel guide 32. Downward pressure is applied to train car 50, as shown in FIG. 7, such that core 24 moves to the compressed position thereby permitting each rail contact surface 54 to contact either cleaning strip 22*a* or 22*b*. In the compressed position, train car 50 is pushed back and forth across cradle 24, which causes wheels 51 to turn and be cleaned. In the preferred embodiment, the material from which foam layer 28 is constructed must be sufficiently soft so as to compress when downward pressure is applied to train car 50 and permit each rail contact surface 54 of wheels 51 to contact cleaning strips 22*a* or 22*b*, sufficiently firm that it will support core 24 in the compressed position under the downward pressure and weight of train car 50, and sufficiently resilient that it will expand and return core 24 to the neutral position when train car 50 is removed.

To use device 10 to clean motorized wheels 55 on model train engine 12, model train engine 12 is placed on device 10 in a similar fashion to model train car 50 described above and as shown in FIG. 1. In the preferred embodiment, the material from which foam layer 28 is constructed is selected for its compressibility and resiliency such that it compresses a sufficient amount to permit contact between each rail contact surface 54 and either cleaning strip 22*a* or 22*b* in response to the weight of the train engine without any additional downward pressure but does not compress to such an extent that friction prohibits wheels 55 from turning when powered by the engine motor as described below. Additional downward pressure may be necessary where the engine weighs less than the average engine for which device 10 is constructed. The material should also be sufficiently resilient such that it will expand and return core 24 to the neutral position when train engine 12 is removed.

Wheels on a model train engine do not spin freely as they do on a model train car and must be turned by an electric motor (not shown) inside train engine 12. Each of wheels 55 has a wheel rim 52 and a rail contact surface 54. When train engine 12 is placed on device 10, each wheel rim 52 is positioned on either side of wheel guide 32 and in contact with conductive strips 30*a* and 30*b*. In the preferred embodiment, an electric current is supplied to device 10 using electrical contacts provided as track contacts 38*a* and 38*b* or prongs 40*a* and 40*b*. To use track contacts 38*a* and 38*b*, device 10 is placed on track 37 such that rails 36*a* and 36*b* are received into rail grooves 34*a* and 34*b* where they are in electrical communication with track contacts 38*a* and 38*b*, all as shown in FIG. 2. When track 37 is connected to a power supply, such as a transformer, electric current flows from the power supply, through rail 36*a*, track contact 38*a*, conductive strip 30*a* and wheels 55, and to the electric motor inside model train engine 12. From the electric motor, electric current flows back through wheels 55, conductive strip 30*b*, track contact 38*b* and rail 36*b* to the power supply where the circuit is completed. The electric motor, powered by the electric current flowing through the circuit, causes wheels 55 to turn and be cleaned on cleaning strips 22*a* and 22*b*. End walls 20*a* and 20*b* prevent train engine 12 from running off cradle 14.

Alternatively, prongs 40*a* and 40*b* are electrically connected to a power supply (not shown) using clips 56 and lead lines 58. The power supply can be a transformer or a section of track 37 connected to a transformer. When connected, electric current flows from the power supply, through prong 40*a*, conductive strip 30*a* and wheels 55 to the electric motor inside model train engine 12. From the electric motor, the current flows back through wheels 55, conductive strip 30*b* and prong 40*b* to the power supply where the circuit is completed. The electric motor, powered by the current flowing through the circuit, causes wheels 55 to turn and be cleaned on cleaning strips 22*a* and 22*b*.

In an alternative embodiment, the resilient portion comprises two coiled springs instead of or in addition to foam layer 28. The springs support core 24 in a neutral position and permit core 24 to move to a compressed position. As described with reference to foam layer 28 in the preferred embodiment, the springs are selected based on their compressibility and resiliency such that they permit core 24 to move into the compressed position in response to the weight of a model train engine without the application of additional downward pressure and sufficiently support core 24 under the weight of a model train engine such that friction does not prohibit the wheels from turning during use. In a second alternative embodiment, a third type of electrical contacts may be provided in the form of an outlet into which a power supply may be plugged, thus eliminating the need for prongs 40*a* and 40*b*. Device 10 could include track contracts and prongs (as described above with regard to the preferred embodiment), track contacts and an outlet, only prongs, only track contacts, or only an outlet. In a further alternative embodiment, cleaning strips 22*a* and 22*b* are made of a woven material, a felt material, a flannel material, a woven material covered with stiff hooks (such as that used for the hook portion of a hook and loop fastener), a buffing material, a woven material covered with bristles, or various grades of an abrasive material, such as sandpaper.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. An apparatus for cleaning the wheels of a model train car when said car is removed from a model train track, said wheels having rims and rail contact surfaces, said apparatus comprising:

a cradle having a base plate and a first and second side wall on opposite sides of said base plate;

a first and second cleaning strip mounted on top of said side walls; and a spring loaded core located between said side walls and moveable relative to said cleaning strips from a neutral position to a compressed position in response to a downward pressure, wherein when said rims of said wheels are positioned on said core and said core is in said compressed position, said rail contact surfaces of said wheels contact said cleaning strips and are cleaned.

2. The apparatus of claim 1, further comprising an elongated wheel guide mounted on top of said core.

3. The apparatus of claim 1, further comprising a plurality of pegs coupled with said core and said base plate, wherein said pegs retain said core between said first and second sidewalls.

4. The apparatus of claim 1, wherein said spring loaded core further comprises a rigid layer and a resilient portion.

5. The apparatus of claim 4, wherein said resilient portion is a foam layer.

6. The apparatus of claim 1, wherein said cleaning strips comprise an absorbent material.

7. The apparatus of claim 1, wherein said cleaning strips are removably mounted to said side walls.

8. An apparatus for cleaning the wheels of a model train engine when said engine is removed from a model train track on which said engine is designed to run, said track having two rails through which electric current flows, said wheels having rims and rail contact surfaces, said apparatus comprising:

a cradle having a base plate and a first and second side wall on opposite sides of said base plate;

a first and second cleaning strip mounted on top of said side walls;

a spring loaded core located between said side walls and moveable relative to said cleaning strips from a neutral position to a compressed position in response to a downward pressure;

a first and second conductive strip; and at least two electrical contacts electrically connected with said conductive strips, wherein when said rims of said wheels are positioned in contact with said conductive strips and said core is in said compressed position, said rail contact surfaces of said wheels contact said cleaning strips, and wherein when electric current is supplied to said electrical contacts said wheels of said engine turn and are cleaned.

9. The apparatus of claim 8, further comprising an elongated wheel guide mounted on top of said core with at least a portion of said conductive strips exposed adjacent said wheel guide.

10. The apparatus of claim 8, wherein said base plate defines a first and second rail groove into which said electrical contacts extend, and wherein when said cradle is placed on said track such that said rail grooves receive said rails, said electrical contacts are electrically connected to said track rails.

11. The apparatus of claim 10, wherein said electrical contacts further comprise a first and second prong extending from said cradle.

12. The apparatus of claim 8, wherein said electrical contacts further comprise a first and second prong extending from said cradle.

13. The apparatus of claim 8, further comprising a plurality of pegs coupled with said core and said base plate, wherein said pegs retain said core between said first and second sidewalls.

14. The apparatus of claim 8, wherein said spring loaded core further comprises a rigid layer and a resilient portion.

15. The apparatus of claim 14, wherein said resilient portion comprises a foam layer.

16. The apparatus of claim 8, wherein said cleaning strips comprise an absorbent material.

17. The apparatus of claim 8, wherein said cleaning strips are removably mounted to said side walls.

* * * * *